US007213359B2

(12) United States Patent
Beretta

(10) Patent No.: US 7,213,359 B2
(45) Date of Patent: May 8, 2007

(54) ADDITIONAL SAFETY DEVICE FOR SEAR MECHANISM FOR FIREARMS

(75) Inventor: Ugo Gussalli Beretta, Trompia (IT)

(73) Assignee: Fabbrica D'armi Pietro Beretta S.p.A, Brescia (IT)

( * ) Notice: Subject to any disclaimer, the term of this patent is extended or adjusted under 35 U.S.C. 154(b) by 491 days.

(21) Appl. No.: 10/883,559

(22) Filed: Jul. 1, 2004

(65) Prior Publication Data

US 2005/0034345 A1 Feb. 17, 2005

Related U.S. Application Data

(63) Continuation-in-part of application No. 10/390,939, filed on Mar. 18, 2003, now Pat. No. 6,769,208.

(30) Foreign Application Priority Data

Mar. 26, 2002 (IT) ..... MI2002A0623

(51) Int. Cl.
*F41A 17/00* (2006.01)

(52) U.S. Cl. ..... 42/70.08; 42/70.09; 42/70.01; 42/69.03

(58) Field of Classification Search ..... 42/70.08, 42/70.09, 70.01, 69.03; 89/27.12
See application file for complete search history.

(56) References Cited

U.S. PATENT DOCUMENTS

| | | | | |
|---|---|---|---|---|
| 960,185 | A * | 5/1910 | Moore | 42/70.09 |
| 5,437,120 | A * | 8/1995 | Dornaus | 42/70.08 |
| 5,881,485 | A * | 3/1999 | Milazzo | 42/70.08 |
| 6,145,234 | A * | 11/2000 | Fluhr | 42/70.08 |

* cited by examiner

*Primary Examiner*—Michelle Clement
(74) *Attorney, Agent, or Firm*—Hedman & Costigan PC; James V. Costigan

(57) ABSTRACT

A sear mechanism for firearms comprises a sear box 12, and an additional safety device to prevent the hammer 16 from releasing accidentally and to fire under the action of inertial forces acting along the direction of the axis of the barrel in case of impact of the firearm, the additional safety device being an interposing element 60 which is slidably mounted below the firing pin latch 43 in a housing having a first inclined plane element 63 and a second inclined plane element 63*a* which are arranged between lateral walls 62 to form a seat 61 which holds element 60 in a first position where it does not interfere with the operation of the firing pin latch 43 but allows said element 60 to move into a position where it prevents the pin latch 43 from moving downwardly to disengage hammer 16.

18 Claims, 6 Drawing Sheets

ADDITIONAL SAFETY DEVICE FOR SEAR MECHANISM FOR FIREARMS

This application is a continuation in part of Ser. No. 10/390,939, now U.S. Pat. No. 6,769,208, filed Mar. 18, 2003, which claims the priority of Italian Application Serial No. MI2002A 000623, filed Mar. 26, 2002.

BACKGROUND OF THE INVENTION (1) Field of the Invention

The present invention refers to a new additional safety device for a sear mechanism for firearms.

(2) Description of Related Art

In general, the field of portable, semi-automatic or automatic firearms foresees different solutions for the sear mechanism, which comprises a mobile element which holds the hammer in the cocking position.

Following the voluntary pulling of the trigger, the mobile element frees the hammer and allows it to hit against a firing pin under the thrust of a preloaded elastic element.

Such a mobile element can be realized, for example as a sear or as a sear pawl, pivoted at a fixed part of the body of the firearm and biased by an elastic element. To carry out its function such a mobile element is thus engaged with both the trigger and with the hammer.

Such a mobile sear element constitutes a delicate detail of the sear mechanism, since it is stressed mechanically and has a complex form, and it is thus generally made from metal.

Since the hammer and the sear element are equipped with additional engagement teeth, due to problems of wear of the interfacing contact surfaces, the hammer must also necessarily be made from metal.

A purpose of the present invention to provide an improved sear mechanism for firearms. U.S. patent application Ser. No. 10/390,939, which is incorporated herein by reference describes a sear mechanism which is adaptable for use in the present invention.

Hereafter specific reference shall be made to a rifle, even though that which is object of the invention can be applied to all firearms, including side-by-side, semi-automatic, rifled and military firearms, etc.

Moreover, given that the invention is intended for experts in the field of firearms, it the detailed description of the structure and operation of a firearm, in particular of a rifle like the one described is omitted. This description is set forth to point out the functions of the parts of a firearm which are the subject matter of the technical problem which is the basis of the invention.

BRIEF SUMMARY OF THE INVENTION

The invention provides a sear mechanism for firearms comprising a sear box 12, a trigger 15 mounted in said sear box 12 on a rotation pin 18 which is acted upon by an elastic return element 25, and having a hammer 16 mounted in said sear box 12 on a pin of the hammer 31 and upon which acts an elastic thrust element 33, said hammer 16 being equipped with a mounting tooth 40 for engaging sear tooth 41, and a breechblock carrier 13 carrying a firing pin 14, and comprising a sear device 17 controlled by said trigger 15 which said hammer 16, motion between a cocking position A in engagement with said sear tooth 41 and a striking position B against said firing pin 14, wherein said sear tooth 41 is fixed and integral with said sear box 12, said hammer pin 31, is in engagement with a slot 32 of said sear box 12 said sear device 17 comprises at one end an engagement element 43 mounted on said hammer pin 31 said pin being adapted to cause said hammer pin to advance in said slot 32, said motion between said cocking position A and said striking position B of said hammer 16 comprising an initial translation step and a subsequent rotary step under the action of said elastic thrust element 33, said sear device 17 being connected at an opposite end thereof to said trigger 15, and including an additional safety device which comprises an interposing element 60 which is slidably mounted below the firing pin latch 43 in a housing having a first inclined plane element 63 and a second inclined plane element 63A which are arranged between lateral walls 62 to form a seat 61 which holds element 60 in a first position where it does not interfere with the operation of the firing pin latch 43 but allows said element 60 to move into a position where it prevents the pin latch 43 from moving downwardly to disengage hammer 16.

The additional passive safety device prevents the hammer 16 from being accidentally released by the disengagement of sear tooth 41 from mounting tooth 40 by an impact force or unforeseen vibration. The passive safety device comprises an interposing element 60 which is slidably mounted below the firing pin latch 43 in a housing having a first inclined plane element 63 and a second inclined plane element 63A which are arranged between lateral walls 62 to form a seat 61 which holds element 60 in a first position where it does not interfere with the operation of the firing pin latch 43 but allows said element 60 to move into either a forward position (FIG. 3A) or rearward position (FIG. 4A) where it prevents the pin latch 43 from moving downwardly to disengage hammer 16.

The additional passive safety device prevents the hammer from releasing accidentally and firing under the action of inertial forces acting along the direction of the longitudinal axis of the barrel due to sudden acceleration. Thus, if the firearm is dropped and either end strikes an object, the interposing element 60 will move along one of the inclined plane elements along the longitudinal axis of the firearm to prevent the firing pin latch 43 from becoming disengaging the hammer 16.

Accordingly, it is a primary object of the present invention to provide an additional passive safety device that is automatically activated under impact conditions that may cause the firing pin latch to disengage but is not activated during the normal handling and firing of the firearm.

Another object of the present invention is to provide a sear mechanism which is lighter and may be made of elements which comprise a plastic material.

Another object of the invention is to permit the use of a low actuation force to activate the trigger and provide a structure which is not subject to excessive wear.

It is also an object of the invention to provide a safer design which is simple to assemble and provides greater cost-effectiveness in manufacturing.

DETAILED DESCRIPTION OF THE INVENTION

Figure 1:
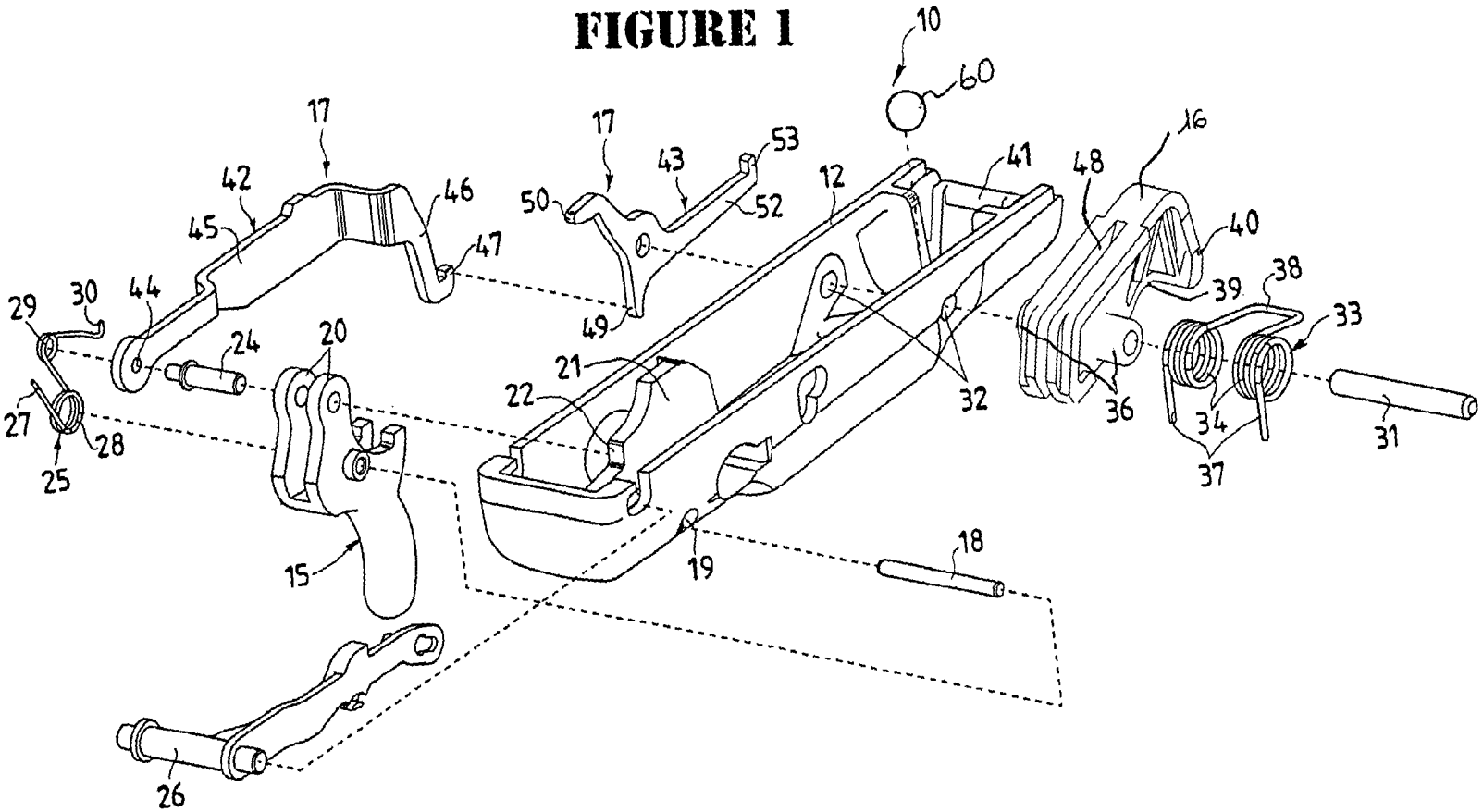
FIG. 1 is an exploded perspective view of a sear mechanism for firearms, that shows a sphere as the additional safety device.
Figure 2:
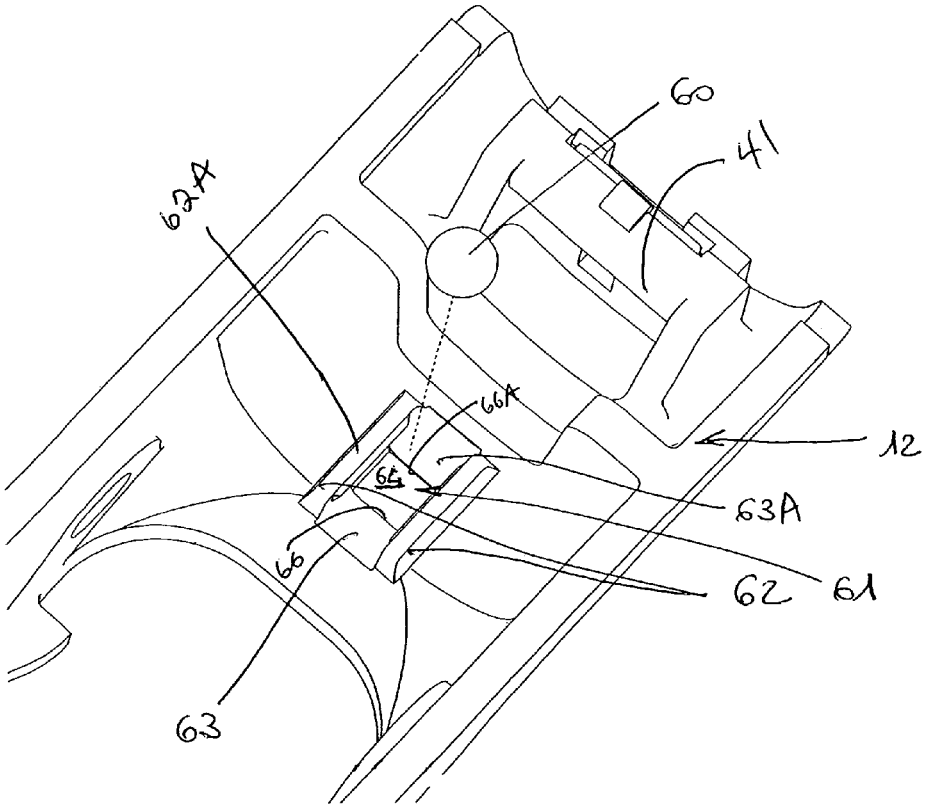
FIG. 2 is an enlarged top view of the additional safety device for a sear mechanism of the present invention.
Figures 3, 3A:
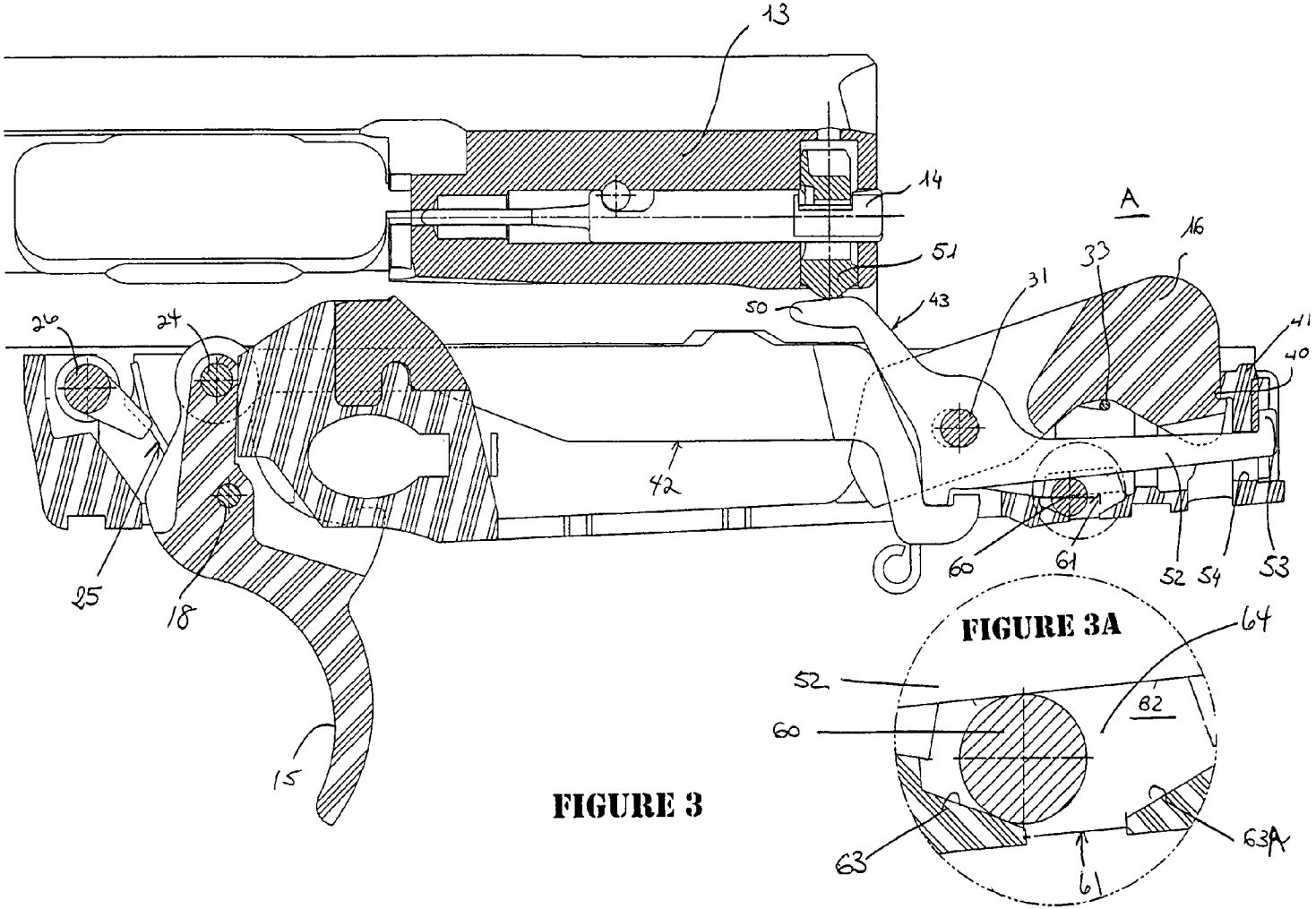
FIG. 3 is a section side view of the sear mechanism in cocking position A, and of the additional safety device with its sphere in a forward position over an inclined element for preventing movement of the firing pin latch and hammer.
FIG. 3A is an enlarged section side view of a portion of FIG. 3 which corresponds to the dotted circle in FIG. 3.

As shown in FIG. 1, the sear mechanism 10 for firearms comprises a sear box 12, which can be inserted in the structure of a firearm, for example in the stock or fore-end.

The firearm comprises a well known breechblock carrier 13 carrying a firing pin 14, as partially shown in FIGS. 3–6.

On the sear box 12 are mounted a trigger 15, a hammer 16 and a sear device 17 which when controlled by trigger 15, releases the hammer 16 from a cocking position A in engagement on sear box 12 and a striking position B against the firing pin 14. As shown in FIGS. 1–6, the trigger 15 is mounted at the sear box 12 through a rotation pin 18, housed in a hole 19, so as to be protruding below the front part of the sear box 12.

The trigger 15 consists of an upper forked portion 20 mounted straddling an abutment rib 21 of the sear box 12. A connection pin 24, to which the sear device 17 is hinged, is applied to the upper forked portion 20 of the trigger. In the sear mechanism 10, described only as an example, the sear device 17 is hinged in offset position and forward with respect to the rotation pin 18.

In the cocking position A and in the striking position B of the hammer, the pin 24 is respectively in abutment with an upper surface portion 22 or a lower surface portion 23 of the rib 21.

An elastic return element 25 acts on the trigger 15. This elastic return element may be a spring, which takes the trigger 15 back to rest position when it is released after firing.

In the proposed embodiment, the return spring 25 also ensures the return into rest position of the sear device 17 hinged to the trigger 15.

The return spring 25 is made up of a first end 27, arranged in abutment on a breechblock locking lever 26, of a first winding 28, arranged around the rotation pin 18 of the trigger, of a second winding 29, arranged around the connection pin 24 between the sear device 17 and the trigger 15 and of a second end 30, arranged in abutment on the sear device 17.

The hammer 16 is mounted at a rear portion of the sear box 12 through a pin of the hammer 31, housed in a slot 32 arranged in such a sear box 12.

An elastic thrusting element 33 acts on hammer 16, which, in the example shown, consists of a spring made up of two windings 34, which are symmetrical with respect to a middle plane 35 of the sear box 12 and are arranged on housing sleeves 36 of the hammer pin 31, which protrude from the side of the hammer 16.

The preloaded thrust spring 33 is equipped with two ends 37, bound to the sear box 12, and with a bridge portion 38 between the windings 34, positioned in abutment on a mobile lower face 39 of the hammer 16.

In the cocking position A, the hammer 16 is held by a fixed sear tooth 41, realised integral with the sear box 12 and matching a mounting tooth 40 arranged on a rear wall of the hammer 16.

Since the sear tooth 41 is fixed, it is possible to make it from plastic, thus allowing plastic to also be used for the hammer. The mass of the sear mechanism is thus substantially reduced whilst still ensuring low wear conditions between the interfacing contact surfaces.

The sear device 17 of the mechanism for firearms 10 is hinged at one of its front ends to the trigger 15 and is equipped at the opposite end with an element for engagement with the pin of the hammer 31.

As shown in FIGS. 1 to 6, the sear device 17 consists of a first translating connection lever 42 and a second rototranslating firing pin latch 43, coupled together through matching engagement means.

The connection lever 42, which has a variously shaped profile, has a perforated front end 44 and is hinged to the connection pin 24 in a lateral position with respect to the trigger 15. In a central portion 45 the connection lever 42 extends next to the inner wall of the sear box 12 and in the rear part has an arm 46, arranged in the middle plane 35 of the sear box 12 and extending downwards, carrying a U-shaped engagement element 47.

The firing pin latch 43, also operating in the middle plane 35 and fitted onto the pin of the hammer 31, constitutes the engagement element with the pin of the hammer suitable for causing it to advance in the slot 32. For such purpose the hammer 16 is equipped with a groove 48 in the middle plane to avoid movement interference.

The firing pin latch 43 consists of three tailpieces which extend downwards, upwards and backwards.

A tapered lower tailpiece 49 constitutes the engagement element matching the U-shaped engagement element 47 of the connection lever 42.

An upper intervention tailpiece 50, extending diagonally towards the front part of the sear box 12, frees the firing pin 14 inside the breechblock 13 when it is pressed against a latch 51 of the firing pin 14. Finally, the firing pin latch 43 is equipped with a rear tailpiece 52, carrying a safety catch 53 in engagement in an opening 54 of the rear wall of the sear box 12.

The sear mechanism 10 has an initial cocking position A (FIG. 3), in which the trigger 15 is in rest position and the hammer 16 is held by the fixed sear tooth 41, following the voluntary pulling of the trigger 15 in the direction of the arrow F, the trigger rotates with a pivot in its rotation pin 18, causing the advance through translation of the first connection lever 42. The connection lever 42 gives the firing pin latch 43 motion which is initially rotational and then translational.

Indeed, since the matching engagement means between the connection lever 42 and the firing pin latch 43 offset at the bottom with respect to the pin of the hammer 31, the firing pin latch 43 is initially made to rotate about the pin of the hammer 31.

The upper intervention tailpiece then goes into abutment against the latch 51 of the firing pin 14 and presses it releasing the motion of the firing pin 14 in the breechblock 13.

Figures 5, 5A:
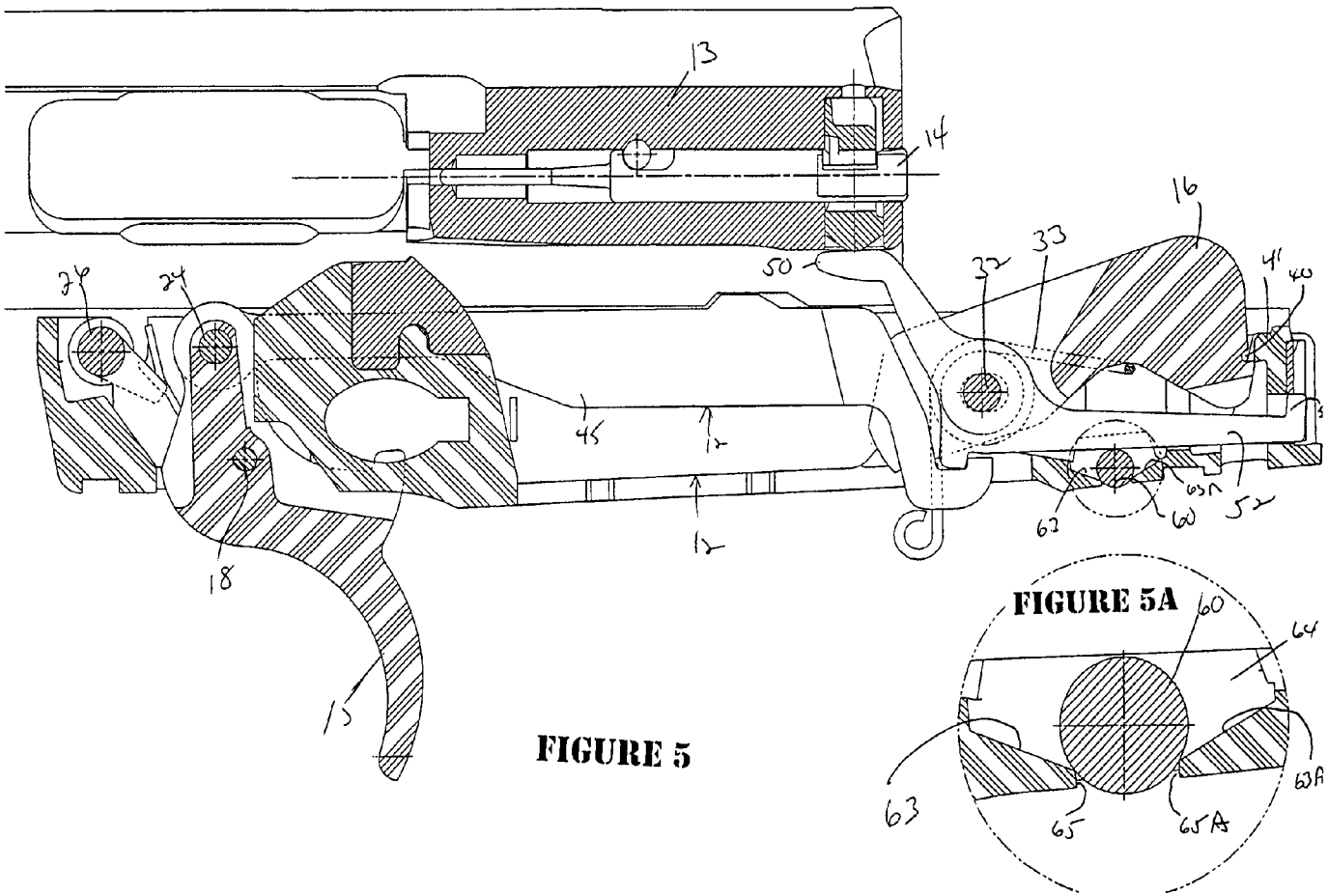
FIG. 5 is a section side view of the sear mechanism in a position with the firing pin unlocked and of the additional safety device with its sphere in a neutral position in the seat, between the two inclined elements of the additional safety device.
FIG. 5A is an enlarged section side view of a portion of FIG. 5 which corresponds to the dotted circle in FIG. 5.

When the sear mechanism 10 is in an unlocking position of the firing pin C, shown in FIG. 5, the further rotary motion of the firing pin latch 43 is prevented. The connection lever 42 then pulls the firing pin latch 43 into translational advancing motion which also involves the hammer 16, the pin 31 of which advances in the slot 32, which allows for translational movement of pin 31.

Figures 6, 6A:
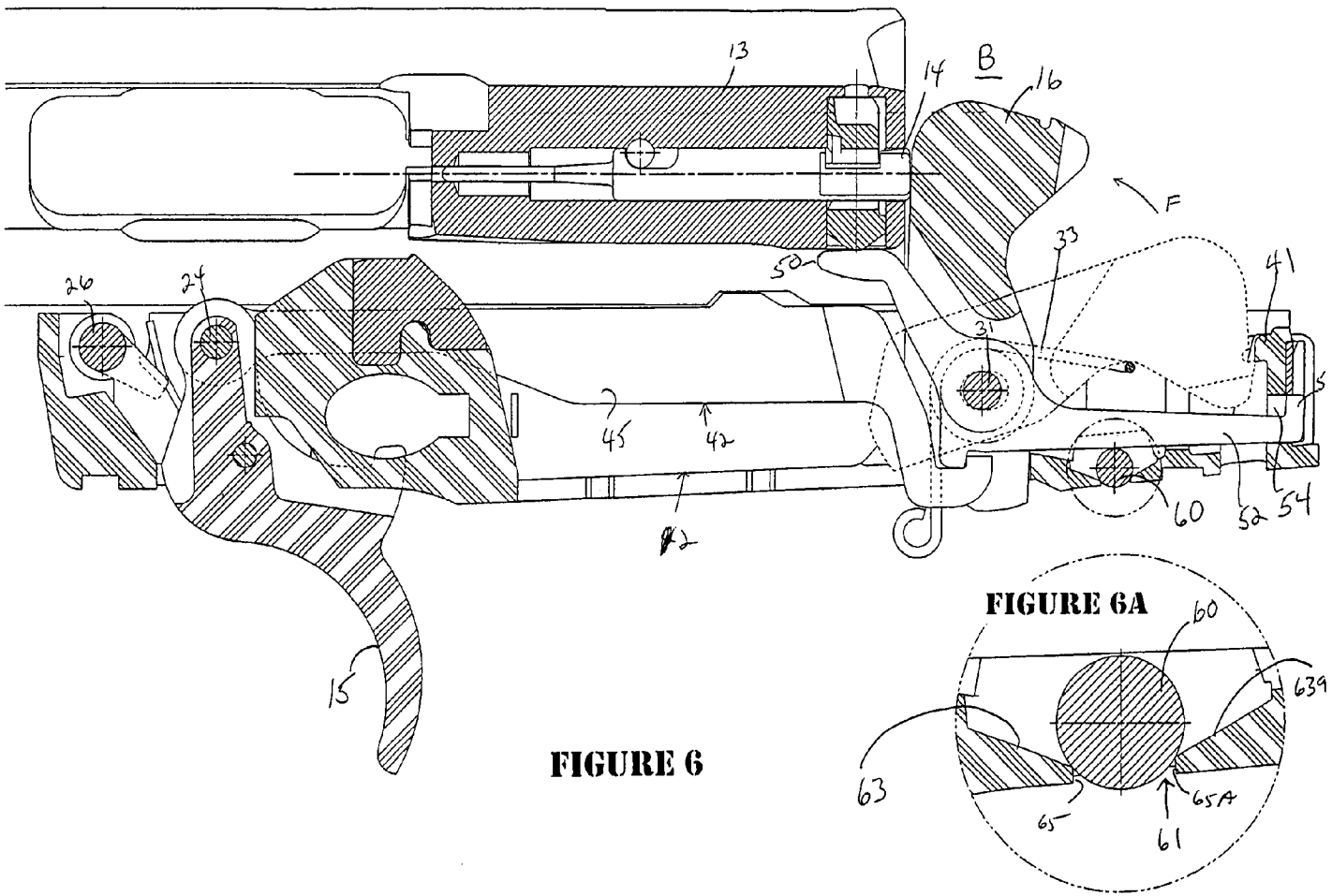
FIG. 6 is a section side view of the sear mechanism with the hammer in striking position B, and of the additional safety device with its sphere in a neutral position in the seat between the two inclined elements that descend to the bottom of the additional safety device.
FIG. 6A is an enlarged section side view of a portion of FIG. 6 which corresponds to the dotted circle in FIG. 6.

The mounting tooth of the hammer 40 is then released from the fixed sear tooth 41 and, thrusted by the preloaded spring 33, goes into the striking position B (FIG. 6).

The motion of the hammer 16 between the cocking position A and the striking position B is therefore made up of an initial translation step and a subsequent rotary step under the action of said elastic thrust spring 33.

The trigger 15, released, returns into the starting position through the effect of the return spring 25, which also resets the initial position of the sear device 17.

The sear mechanism 10, according to the proposed embodiment, when it is in cocking position A, is equipped with a safety device which prevents the firing of an accidental shot following hard knocks, such as those generated by the use of the firearm to knock down an obstacle, or in the case of the firearm itself being falling to the ground.

Indeed, the translational movement of the pin of the hammer 31 and of the hammer 16 itself to free the mounting tooth 40 from the fixed sear tooth 41 is prevented by the safety catch 53 of the firing pin latch 43, which is in engagement in the opening 54 of the sear box 12.

Only by pulling the trigger 15 is it possible to cause the rotation of the rear tailpiece 52 carrying the safety catch 53, which releases it from the opening 54 of the sear box 12, allowing the subsequent translational movement of the firing pin latch 43 and thus of the hammer 16.

The sear mechanism for firearms which is subject of the present invention has the advantage of making possible the elimination of the sear connecting lever to hold the hammer in cocking position.

The fact that the hooking of the mounting tooth of the hammer to a fixed tooth of the sear box has been foreseen advantageously allows the hammer to be made from plastic, making the structure substantially lighter. Indeed, due to problems of wear of the interfacing contact surfaces, the hammer can be made from plastic only if the sear tooth is also made from plastic.

Moreover, the sear mechanism, object of the present invention, has a simplified structure, consisting of a low number of components, which advantageously allows a great cost-effectiveness of construction and simplicity of assembly to be obtained.

The firearm comprises a breechblock carrier 13 carrying a firing pin 14, only partially represented in FIGS. 3 to 6 and already known.

On the sear box 12 are mounted a trigger 15, a hammer 16 and a sear device 17 which, when controlled by the trigger 15, gives the hammer 16 motion between a cocking position A in engagement on the sear box 12 and a striking position B against the firing pin 14.

The additional safety device of the invention provides a passive safety device that is activated by sudden acceleration or sudden impact loads on the firearm without any intervention of the user of the firearm.

When the firearm is subjected to sudden acceleration which results in an impact such as is caused by the dropping of a firearm on a hard surface, inertial forces may be generated which may cause the moveable parts to move and cause the disengagement of the firing pin latch 43 from the opening 54 of the sear box 12. The hammer 16, being held in place in this condition only by the elastic return element 25, may be released and strike the firing pin which can cause an accidental firing.

As shown in FIGS. 1 to 6, the additional safety device of the sear mechanism, comprises an interposing element 60 housed in a seat 61 of the sear box 12 under the rear tailpiece 52 of the safety catch 53. In a preferred embodiment, for example shown in FIG. 1 and in the enlarged detail of FIG. 2 the interposing element 60 is a sphere and the seat 61 comprises lateral containment walls 62 and 62A which are arranged parallel to each other along the longitudinal axis of the firearm. The distance between the lateral walls 62 and 62A is slightly greater than the sphere's diameter. The inclined plane elements 63 and 63A are arranged between the lateral walls 62 facing each other and are inclined to converge towards one another at the bottom of the seat 61. The inclined plane elements 63 and 63A are spaced by a distance less than the sphere's diameter to form a seat 61 which is a constriction between the inclined plane elements 63 and 63A having an open bottom as shown in FIG. 4A. FIG. 3A shows sphere 60 in a forward position which sphere 60 would assume if translational movement were induced by sudden acceleration caused by dropping the firearm on its muzzle (not shown). FIG. 4A shows sphere 60 in a rearward position which sphere 60 would assume if translational movement were induced by sudden acceleration caused by dropping the firearm on its butt end (not shown). FIG. 5A shows sphere 60 in a neutral position which sphere 60 would assume when the firearm was held in a substantially level position (not shown). FIG. 6A shows sphere 60 in a neutral position which sphere 60 would assume when the firearm has just been fired as shown by the hammer 16 in contact with firing pin 14.

The sphere 60 moves in response to sudden high impact forces (inertial forces) which also act on safety catch 53. The inertial force causes sphere 60 to move along the inclined plane elements 63, 63A into position under the rear tailpiece 52 of the safety catch 53 to prevent the safety catch 53 from moving downwardly under the influence of inertial forces. After the termination of the application of an inertial force, caused by sudden acceleration, only gravity acts on the sphere 60 which is free to move according to the orientation of the firearm. For example, the gravitational forces applied to sphere 60 by moving the firearm, e.g. from the horizontal position to a non-horizontal position cause the sphere 60 to move out of the neutral position under the tailpiece 52. During normal firing, when the trigger activates the firing mechanism, the safety catch 53 is rotated and the rear tailpiece 52 shifts the sphere 60 downwardly towards the bottom of the seat 61, i.e. in the neutral position where it does not interfere with the firing operation where it does not interfere with the firing operation.

Figures 4, 4A:
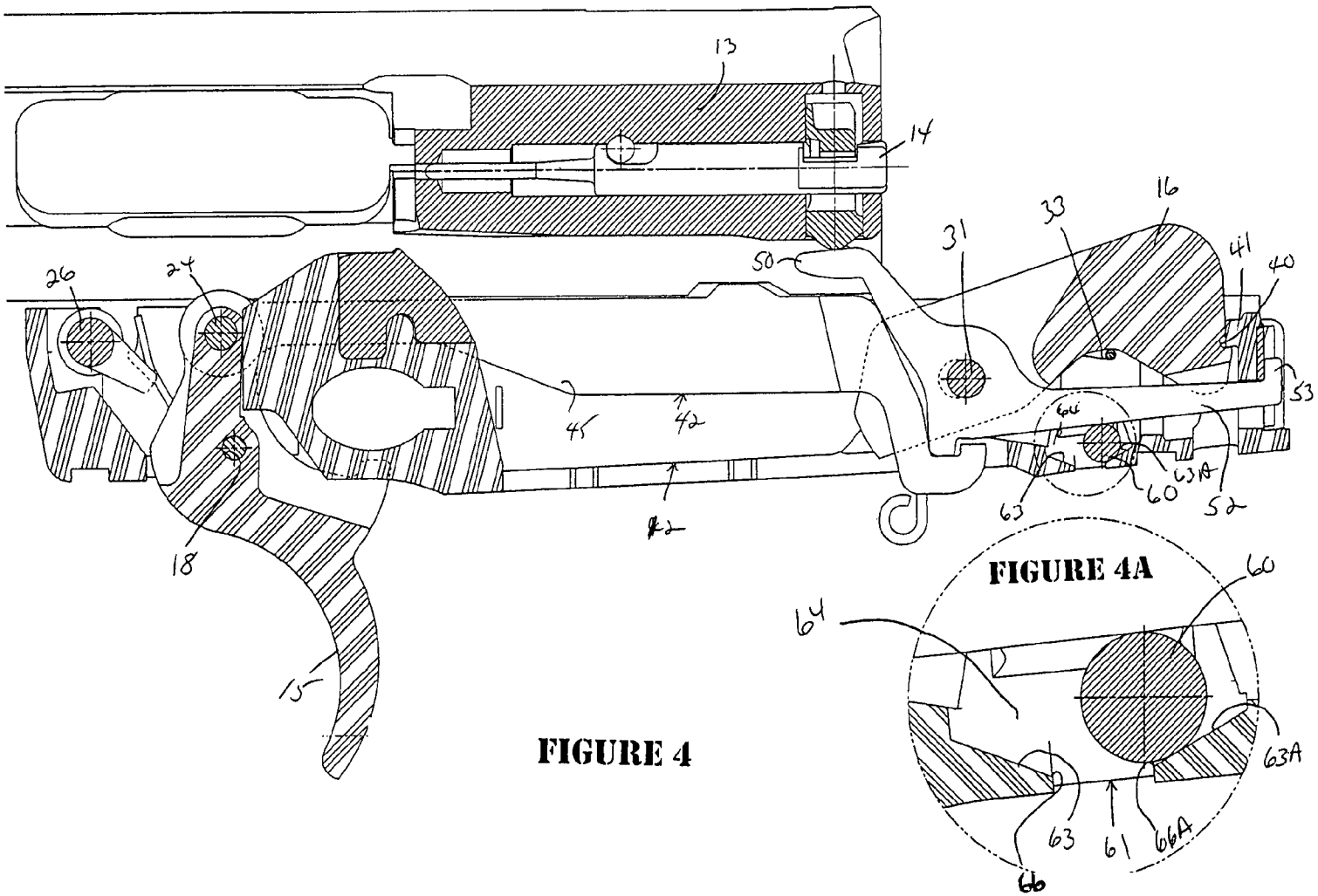
FIG. 4 is a side section side view of the sear mechanism and of the additional safety device with its sphere in a backward position over an inclined element for preventing movement of the firing pin latch and hammer.
FIG. 4A is an enlarged section side view of a portion of FIG. 4 which corresponds to the dotted circle in FIG. 4.

FIG. 5A shows the terminal edges 65 and 65A of inclined plane 63 and 63A as having a substantially flat profile that provides support points 66 and 66A as shown in FIG. 4A that provide a stop for sphere 60.

When inertial forces are directed either towards the front or towards the rear part of the firearm, the sphere slides or translates respectively over the front inclined plane element 63 or rear inclined plane element 63A (FIGS. 3 and 4) interposing itself between the rear tailpiece 52 of the safety catch 53 and the sear box 12. Any downward movement of the firing pin latch 43 which could cause release of the hammer 16 is therefore prevented.

When the firearm is handled for firing, the sphere 60 is housed in an opening 64 on seat 61 (FIGS. 5 and 6) and does not interfere with the downward movement of the firing pin latch 43. Seat 61 is formed by the spaced opening defined by inclined planes 63 and 63A.

While the preferred embodiment of the interposing element 60 is a sphere or ball of a material which may be metal or plastic, it is possible to use other spherically shaped elements which can exhibit translational or rotational movement in response to sudden acceleration caused by impact loading. These spherically shaped elements may comprise rounded objects of varying geometries that can be slidably mounted in opening 64 on the bottom of seat 61. Further, cylinders or rollers as well as sliding wedges may be provided as interposing elements.

I claim:

1. Sear mechanism for firearms comprising a sear box (12), a trigger (15) mounted in said sear box (12) on a rotation pin (18) which is acted upon by an elastic return element (25), and having a hammer (16) mounted in said sear box (12) on a pin of the hammer (31) and upon which acts an elastic thrust element (33), said hammer (16) being equipped with a mounting tooth (40) for engaging sear tooth (41), and a breechblock carrier (13) carrying a firing pin (14), and comprising a sear device (17) controlled by said trigger (15) which said hammer (16), motion between a cocking position A in engagement with said sear tooth (41) and a striking position B against said firing pin (14), wherein said sear tooth (41) is fixed and integral with said sear box (12), said hammer pin (31), is in engagement with a slot (32) of said sear box (12) said sear device (17) comprises at one end an engagement element (43) mounted on said hammer pin (31) said pin being adapted to cause said hammer pin to advance in said slot (32), said motion between said cocking position A and said striking position B of said hammer (16) comprising an initial translation step and a subsequent rotary step under the action of said elastic thrust element (33), said sear device (17) being connected at an opposite end thereof to said trigger (15), and including an additional safety device which comprises a interposing element (60) which is slidably mounted below the firing pin latch (43) in a housing having a first inclined plane element (63) and a second inclined plane element (63*a*) which are arranged between lateral walls (62) to form a seat (61) which holds interposing element (60) in a first position where it does not interfere with the operation of the firing pin latch (43) but allows said element (60) to move into a position where it prevents the pin latch (43) from moving downwardly to disengage hammer (16).

2. Mechanism according to claim 1, wherein said interposing element is a spherically shaped element (60).

3. Mechanism according to claim 1, wherein said sear device (17) is hinged to said trigger (15) through a connection pin (24).

4. Mechanism according to claim 3, wherein said connection pin (24) is applied to said trigger (15) in an offset and advanced position with respect to said rotation pin (18).

5. Mechanism according to claim 1, wherein said sear device (17) consists of a translating connection lever (42) and a rototranslating firing pin latch (43), which comprises said engagement element with said pin of the hammer (31) suitable for causing said hammer (31) to advance in said slot (32), said firing pin latch (43) being fitted onto said pin of the hammer (31) and equipped with an upper intervention tailpiece (50) with a latch (51) of said firing pin (14), suitable for freeing said firing pin (14) inside said breechblock (13), said connection lever (42) and said firing pin latch (43) being equipped with matching engagement means (46), (47), (49).

6. Mechanism according to claim 5, wherein said connection lever (42) is suitable for giving said rototranslating firing pin latch (43) an initial rotary motion until the intervention of said upper tailpiece (50) and then translational advancing motion.

7. Mechanism according to claim 5, wherein said matching engagement means (46), (47), (49) are offset at the bottom with respect to said pin of the hammer (31) and suitable for causing the initial rotation of said firing pin latch (43) about said pin of the hammer (31).

8. Mechanism according to claim 5, wherein said firing pin latch (43) is equipped with a safety catch (53) in engagement in said sear box (12), suitable for releasing following said rototranslational movement of said firing pin latch (43).

9. Mechanism according to claim 3, wherein said elastic return element (25) of said trigger (15) is a return spring made up of an end (27) in abutment on a breechblock locking lever (26), a first winding (28) arranged around said rotation pin of the trigger (18), a second winding (29) arranged around said connection pin (24) between said sear device (17) and said trigger (16) and a second end (30) in abutment on said sear device (17).

10. Mechanism according to claim 1, wherein said trigger (15) consists of an upper forked portion (20) mounted straddling an abutment rib (21) of said sear box (12).

11. Mechanism according to claim 10, wherein a connection pin (24) of said sear device (17) to said trigger (15) is in abutment respectively with an upper surface (22) or a lower surface (23) of said rib (21) in said cocking position A of the hammer and in said striking position B.

12. Mechanism according to claim 1, wherein said hammer (16) is equipped with side sleeves (36) for housing said, and said elastic thrust element of the hammer (33) is a thrust spring made up of two windings (34) arranged on said side sleeves (36), and having two ends (37) attach to said sear box (12) and a bridge portion (38) between said windings (34) in abutment on a lower face (39) of said hammer (61).

13. Mechanism according to claim 1, wherein said hammer (16) is equipped with a groove in a middle plane (35) of said sear box (12) for the intervention of said engagement element (43) with said pin of the hammer (31).

14. Mechanism according to claim 1, wherein said hammer (16) and said fixed sear tooth (41) are made from plastic.

15. Mechanism according to claim 1, wherein said rotation pin of the trigger (18) is housed in a hole (19) of said sear box (12).

16. Mechanism according to claim 4, wherein said matching engagement means consists of an arm (46) arranged in a middle plane (35) of said sear box (12) and extending downwards, equipped with a U-shaped engagement element (47) and of a tapered lower tailpiece (49) of said firing pin latch (43) suitable for engaging said element (47).

17. In a firearm having a sear mechanism comprising a sear box (12), a trigger (15) mounted in said sear box (12) on a rotation pin (18) which is acted upon by an elastic return element (25), and having a hammer (16) mounted iii said sear box (12) on a pin of the hammer (31) and upon which acts an elastic thrust element (33), said hammer (16) being equipped with a mounting tooth (40) for engaging sear tooth (41), and a breechblock carrier (13) carrying a firing pin (14), and comprising a sear device (17) controlled by said trigger (15) which said hammer (16), motion between a cocking position A in engagement with said sear tooth (41)

and a striking position B against said firing pin (41), wherein said sear tooth (41) is fixed and integral with said sear box (12), said hammer pin (31), is in engagement with a slot (32) of said sear box (12) said sear device (17) comprises at one end an engagement element (43) mounted on said hammer pin (31) said pin being adapted to cause said hammer pin to advance in said slot (32), said motion between said cocking position A and said striking position B of said hammer (16) comprising an initial translation step and a subsequent rotary step under the action of said elastic thrust element (33), said sear device (17) being connected an opposite end thereof to said trigger (15) the which comprises an additional safety device comprising an interposing element (60) which is slidably mounted below the firing pin latch (43) in a housing having a first inclined plane element (63) and a second inclined plane element (63*a*) which are arranged between lateral walls (62) to form a seat (61) which holds element (60) in a first position where it does not interfere with the operation of the firing pin latch (43) but allows said element (60) to move into a position where it prevents the pin latch (43) from moving downwardly to disengage hammer (16).

18. In a firearm according to claim 17, wherein said interposing element (60) is a spherically shaped element.

* * * * *